US012727683B2

(12) United States Patent
Schaffer et al.

(10) Patent No.: US 12,727,683 B2
(45) Date of Patent: Sep. 8, 2026

(54) SYSTEMS AND METHODS FOR CHILD SUPPORT SYSTEMS WITH A DIVISABLE SUPPORT STRUCTURE

(71) Applicant: Graco Children's Products Inc., Atlanta, GA (US)

(72) Inventors: Alexis Jude Schaffer, Philadelphia, PA (US); Annette C. Stella, Downingtown, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 18/893,700

(22) Filed: Sep. 23, 2024

(65) Prior Publication Data

US 2025/0107639 A1 Apr. 3, 2025

Related U.S. Application Data

(60) Provisional application No. 63/587,405, filed on Oct. 2, 2023.

(51) Int. Cl.
*A47D 13/06* (2006.01)
*A47D 9/00* (2006.01)

(52) U.S. Cl.
CPC ..... *A47D 9/012* (2022.08); *A47D 13/06* (2013.01)

(58) Field of Classification Search
CPC ..... A47D 13/06; A47D 13/063; A47D 9/012; A47D 9/016
See application file for complete search history.

(56) References Cited

U.S. PATENT DOCUMENTS 1,092,298 A * 4/1914 Schwarz ..... A47C 21/00 5/512
4,890,346 A * 1/1990 Rist ..... A47D 15/008 5/946
5,170,520 A * 12/1992 Milliken ..... A47D 9/008 5/98.1
5,350,341 A * 9/1994 Wolscht ..... A47D 9/005 5/658
5,867,850 A * 2/1999 Mariol ..... A47D 9/016 5/98.1
9,155,402 B1 * 10/2015 Whitman ..... A47D 7/002
(Continued)

FOREIGN PATENT DOCUMENTS

AR 122224 A1 8/2022
GB 2113502 B 8/1983
(Continued)

*Primary Examiner* — Matthew Troutman
*Assistant Examiner* — Ifeolu A Adeboyejo
(74) *Attorney, Agent, or Firm* — Eversheds Sutherland (US) LLP

(57) ABSTRACT

Child support systems that include a support structure and a divider connected to the support structure for transitioning the support structure between an undivided space and a divided space is provided. The child support system may include a divider that may be connected to a bottom portion of a support structure and may transition between an upward position for dividing the usable space of the support structure and a downward position for leaving the useable space of the support structure in an undivided configuration. The divider may be secured using wings, velcro attachments and/or tabs.

18 Claims, 7 Drawing Sheets

(56) References Cited

U.S. PATENT DOCUMENTS

| | | | | |
|---|---|---|---|---|
| 9,392,881 | B1 | 7/2016 | Schmelzle | |
| 9,821,240 | B2 | 11/2017 | Hansen et al. | |
| 10,080,444 | B2 * | 9/2018 | Whitman | A47D 13/061 |
| 10,258,761 | B2 | 4/2019 | Smudde | |
| 10,300,242 | B2 | 5/2019 | Hanson | |
| 10,307,563 | B1 | 6/2019 | Kooyers | |
| 11,903,495 | B1 * | 2/2024 | Bickel | A47D 13/061 |
| 2004/0130449 | A1 | 7/2004 | Hung | |
| 2006/0218725 | A1 * | 10/2006 | Carpenter | A47D 9/016 5/95 |
| 2007/0289060 | A1 * | 12/2007 | Berkey | A47D 9/016 5/98.1 |
| 2019/0134346 | A1 | 5/2019 | Kirby et al. | |
| 2021/0228150 | A1 | 7/2021 | Karp et al. | |
| 2021/0299398 | A1 | 9/2021 | Chi | |
| 2021/0338972 | A1 | 11/2021 | Karp et al. | |
| 2021/0361172 | A1 | 11/2021 | Fornell | |
| 2022/0110458 | A1 * | 4/2022 | Wu | A47D 15/003 |
| 2022/0338642 | A1 | 10/2022 | Connor | |
| 2022/0378223 | A1 * | 12/2022 | Whitman | A47D 13/063 |
| 2023/0126721 | A1 | 4/2023 | Davidson-Busch | |
| 2023/0132753 | A1 | 5/2023 | Rabin et al. | |
| 2023/0133956 | A1 | 5/2023 | Root | |
| 2023/0397773 | A1 * | 12/2023 | Saxton | A47K 3/024 |
| 2024/0185695 | A1 | 6/2024 | Luecke | |

FOREIGN PATENT DOCUMENTS

| | | | |
|---|---|---|---|
| GB | 2464333 | A | 4/2010 |
| GB | 2467306 | B | 8/2014 |
| IN | 202211032878 | A | 6/2022 |
| IN | 202211052206 | A | 9/2022 |
| IN | 202241076436 | A | 6/2023 |
| WO | 2022098951 | A1 | 5/2022 |

* cited by examiner

SYSTEMS AND METHODS FOR CHILD SUPPORT SYSTEMS WITH A DIVISABLE SUPPORT STRUCTURE

CROSS-REFERENCE TO RELATED APPLICATION

This application claims the benefit of U.S. Application No. 63/587,405, filed Oct. 2, 2023, the entirety of which is hereby incorporated by reference.

TECHNICAL FIELD

The present disclosure is generally in the field of infant and child support structures and systems, and more particularly related to support child support systems with a divider for dividing a support structure.

BACKGROUND

Systems such as playards, pack-n-plays, and cribs may be used to comfortably and safely support a sleeping infant or young child. Such systems may also be used as a safe and contained space in which a child may rest or play. Further, playards, pack-n-plays, and cribs may be used as changing tables or for other purposes relating to supporting an infant or young child.

Playards, pack-n-plays, and cribs are traditionally four walled stationary structures within which a mattress or other padded surface may extend, offering a comfortable and safe area for an infant or child to play, rest, or sleep. Such systems are typically used for newborns, toddlers, and even older children. As a result, the support area defined by the perimeter of the four-walled structure may be ideal for a child of a certain size (e.g., toddler) but may be undesirable for a child of a smaller size (e.g., infant). It may be desirable for an infant to have a smaller rest area for rest or sleep than a toddler, for example. However current systems to not offer easily adjust spaces for sleep, rest, and/or play.

A need remains for a child support system with an adjustable support area capable of being easily modified to better accommodate children of different ages.

SUMMARY

The present disclosure describes child support systems that include a support structure and a divider connected to the support structure for transitioning the support structure between an undivided space and a divided space.

In embodiments, the present disclosure describes a child support system having dividable spaces. The child support structure may include a support structure having a set of walls and a bottom portion connected to the set of walls and a first and second wall of the set of walls each having a connection portion as well as a third wall of the set of walls having a first pocket. The child support structure may further include a divider positioned between the first and second wall, the divider coupled to the bottom support and designed to transition between a first position parallel with the bottom portion and a second position orthogonal to the bottom portion. The divider may have connectors at a first and a second end of the divider designed to couple to a respective connection portion. The divider may further include a second pocket. The child support system may also include a multi-paneled structure having a first end designed to be positioned in the first pocket and a second end designed to be positioned in the second pocket.

In embodiments, the present disclosure describes yet another child support system having dividable spaces. The child support structure may include a support structure having a set of walls and a bottom portion connected to the set of walls. A first and second wall of the set of walls may each have a velcro portion and/or may have any other connection mechanism (e.g., buttons, snaps, zippers, etc.). The child support structure may further include a divider positioned between the first and second wall. The divider may be coupled to the bottom support and designed to transition between a first position parallel with the bottom portion and a second position orthogonal to the bottom portion. The divider may have velcro connectors and/or any other connection mechanism at a first and second end of the divider and may be designed to couple to respective velcro portions and/or other connection mechanism to secure the divider in the second position.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

The present disclosure provides a more detailed and specific description with reference to the accompanying drawings. The drawings and specific descriptions of the drawings, as well as any specific or other embodiments discussed, are intended to be read in conjunction with the entirety of this disclosure.

DETAILED DESCRIPTION

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical elements throughout.

Figure 1:
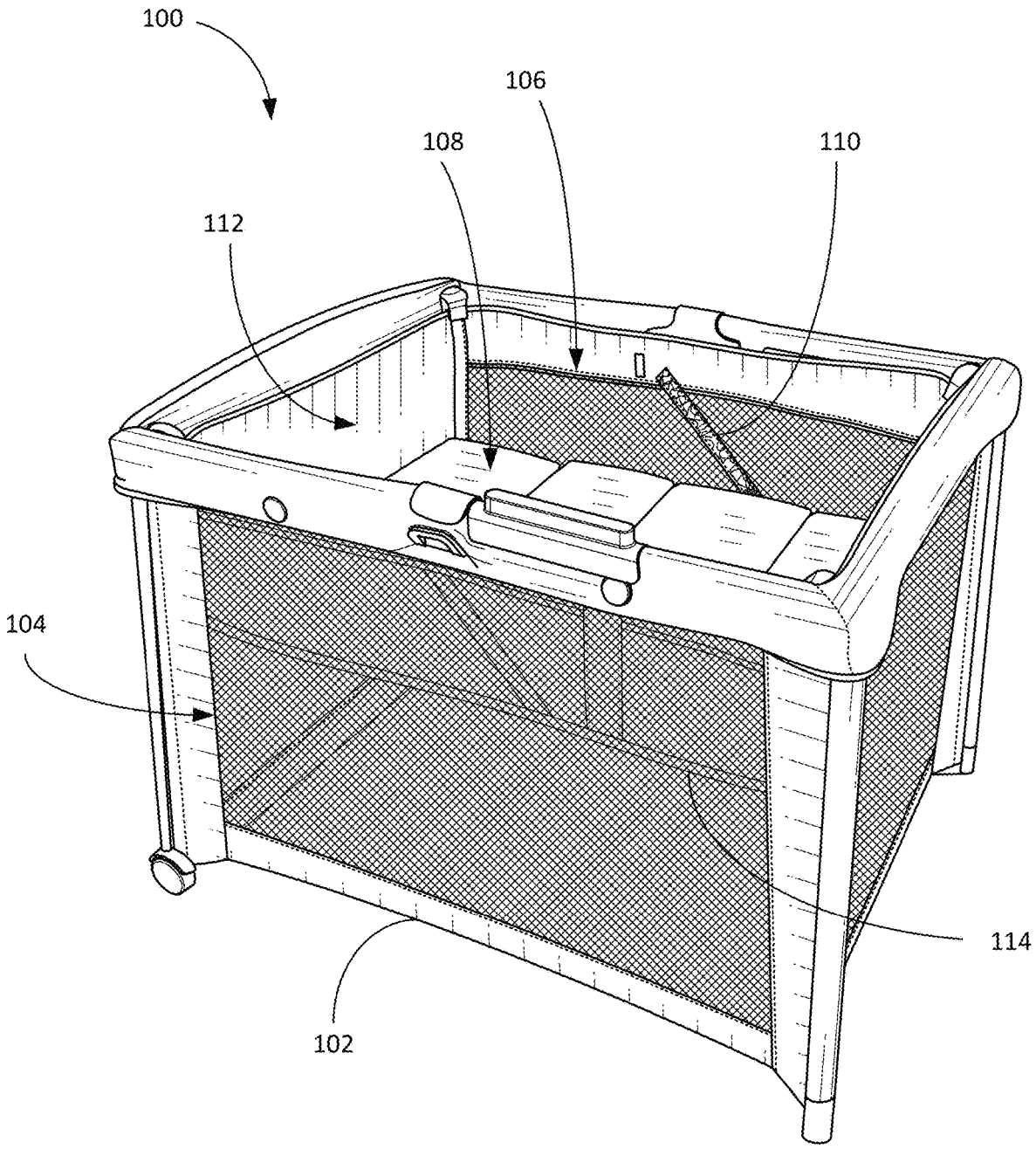
FIG. 1 is perspective view of a child support system including a base with walls, a support structure, a divider, and a multi-paneled structure, in accordance with one or more example embodiments of the present disclosure.

Referring now to FIG. 1, a child support system including a base with walls, a support structure, a divider, and a multi-paneled structure is depicted, in accordance with one or more example embodiments of the present disclosure. As shown in FIG. 1, child support system 100 may be a playard, pack-n-play, crib, and/or the like. Child support system 100 may include a base 102 which may have an internal structure for supporting child support system 100 (e.g., tubing, struts, bars, and/or any other suitable support structure). Base 102 may support multiple walls, which may be made from mesh, fabric, and/or any other suitable material.

As shown in FIG. 1, walls 104 may include four walls arranged in cuboid and/or cube shape. While four walls are illustrated in FIG. 1, it is understood that walls 104 may include fewer than four walls. Base 102 may be stationary or may include wheels for moving child support system from one location to another.

Child support system 100 may further include support structure 106 which may be positioned on walls 104. For example, support structure 106 may be clipped onto or otherwise extend over or secured to an upper portion of walls 104. Support structure 106 may include walls 112 and bottom portion 114. Bottom portion 114 may be a generally flat structure that extends between and is orthogonal to walls 104. Walls 112 may include four walls and may optionally be generally parallel to walls 104. Bottom portion 114 may be connected to walls 112 and/or may extend from walls 106.

Bottom portion 114 and/or walls 112 may be made from fabric, mesh, and/or other suitable material. Bottom portion 114 may be reinforced with one or more rigid supports (e.g., tubing, piping, struts, and/or the like). Rigid supports may be removable and/or collapsible. Bottom portion 114 may further include a divider (e.g., not shown) which may divide the space defined by bottom portion 114 and walls 112 and may transition between an upward position illustrated in FIG. 3 and a downward position shown in FIG. 1.

When divider is in a downward position, multi-paneled structure 108 may be positioned over the divider and may extend the length and width of bottom portion 114 and may be positioned between walls 112. Multi-paneled structure 108 may include multiple panels (e.g., 3, 4, 5, or more than 5). In one example, multi-paneled structure 108 may be padded on one side (e.g., facing upward) and may be rigid on the other side. An infant or child may rest, play, and/or sleep on the padded side of the multi-paneled structure.

Opposing walls of walls 112 may include connection portions 110 which may extend between a top portion and a bottom portion of the respective wall. For example, connection portions 110 may be velcro regions designed to be adhered to opposing velcro that comes into contact with connection portions 110. For example, the divider may include the opposing portions of velcro and connection portions 110 may secure the divider in an upward position. In another example, connection portions 110 may be a zipper connection for connecting to a counterpart zipper connection of the divider.

Figure 2:
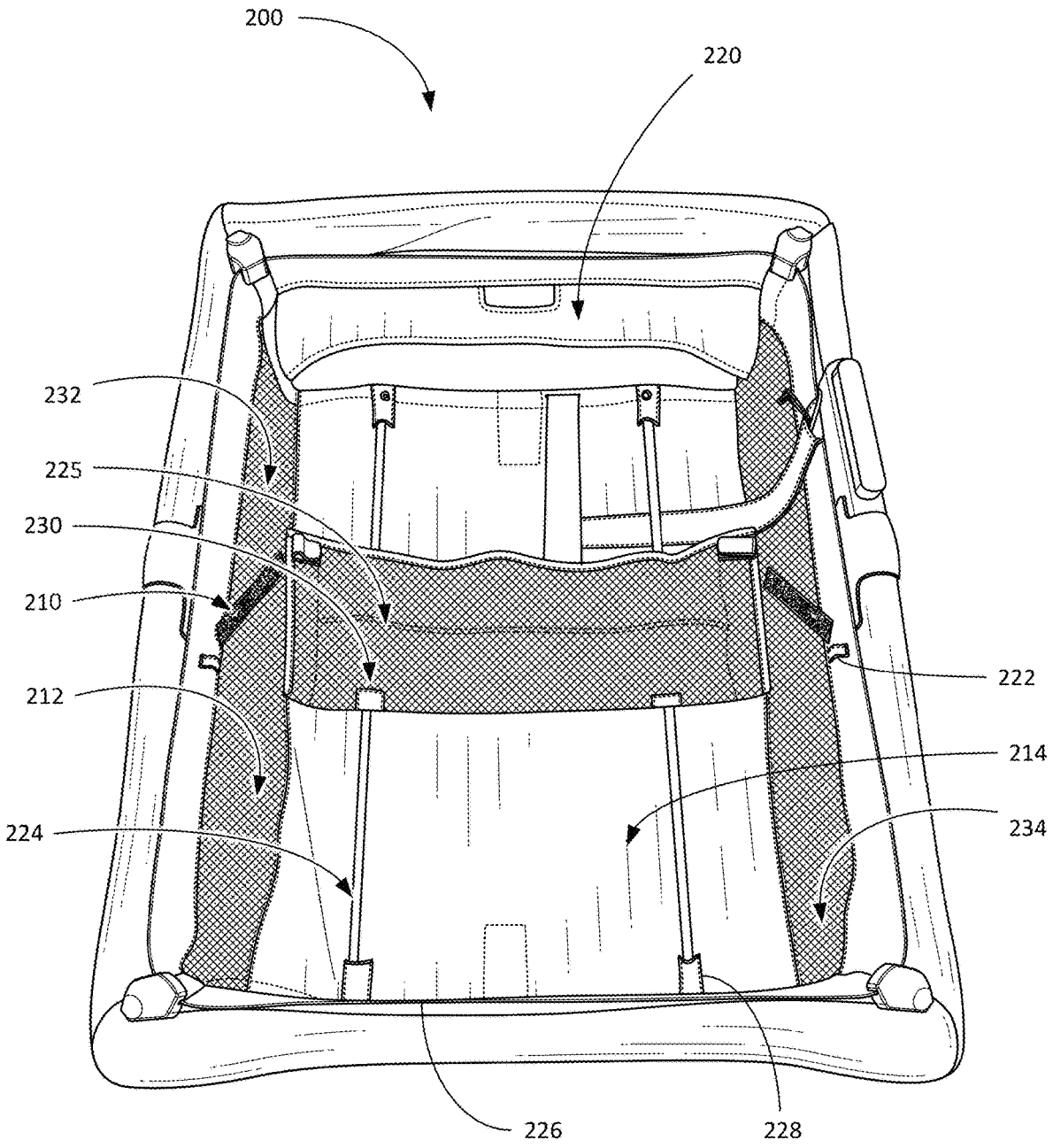
FIG. 2 is a top down view of a child support system including a support structure and a divider in downward position, in accordance with one or more example embodiments of the present disclosure.

Referring now to FIG. 2, a top down view of a child support system including a support structure and a divider in downward position is depicted, in accordance with one or more example embodiments of the present disclosure. As shown in FIG. 2, support structure 220 may be the same as or similar to support structure 106 of FIG. 1. Support structure 200 may rest upon and/or may be secured to a base of child support system 200. In some instances, the mattress structure may rest over the divider 225.

Support structure 220 may include walls 212 which may include two side walls, a front wall, and a rear wall. Walls 212 may be the same as or similar to walls 112. Supports 224 may extend between wall 220 and rear wall 226 along bottom portion 214. For example, bottom portion 214 may include receiving areas 228, for securing supports 224 to bottom portion 214. In one example, supports 224 may be tubes and/or struts.

Divider 225 may be connected to bottom portion 214 and may extend between two opposing walls of walls 212. For example, divider may extend between wall 232 and wall 234. Walls 232 and 234 may include connection portions 210 which may be the same as or similar to connection portions 110. In one example divider may be sewn to bottom portion 214. However, it is understood that divider may be otherwise secured to bottom portion 114 in any other suitable manner. Alternatively, divider may be connected to bottom portion 214 via a zipper connection. Divider 225 may include tunnels 230, permitting structures 224 to extend through tunnels 230. Divider 225 is shown in the downward position in FIG. 2. The divider panel 225 can be stored under the mattress when not in use mode.

Figure 3:
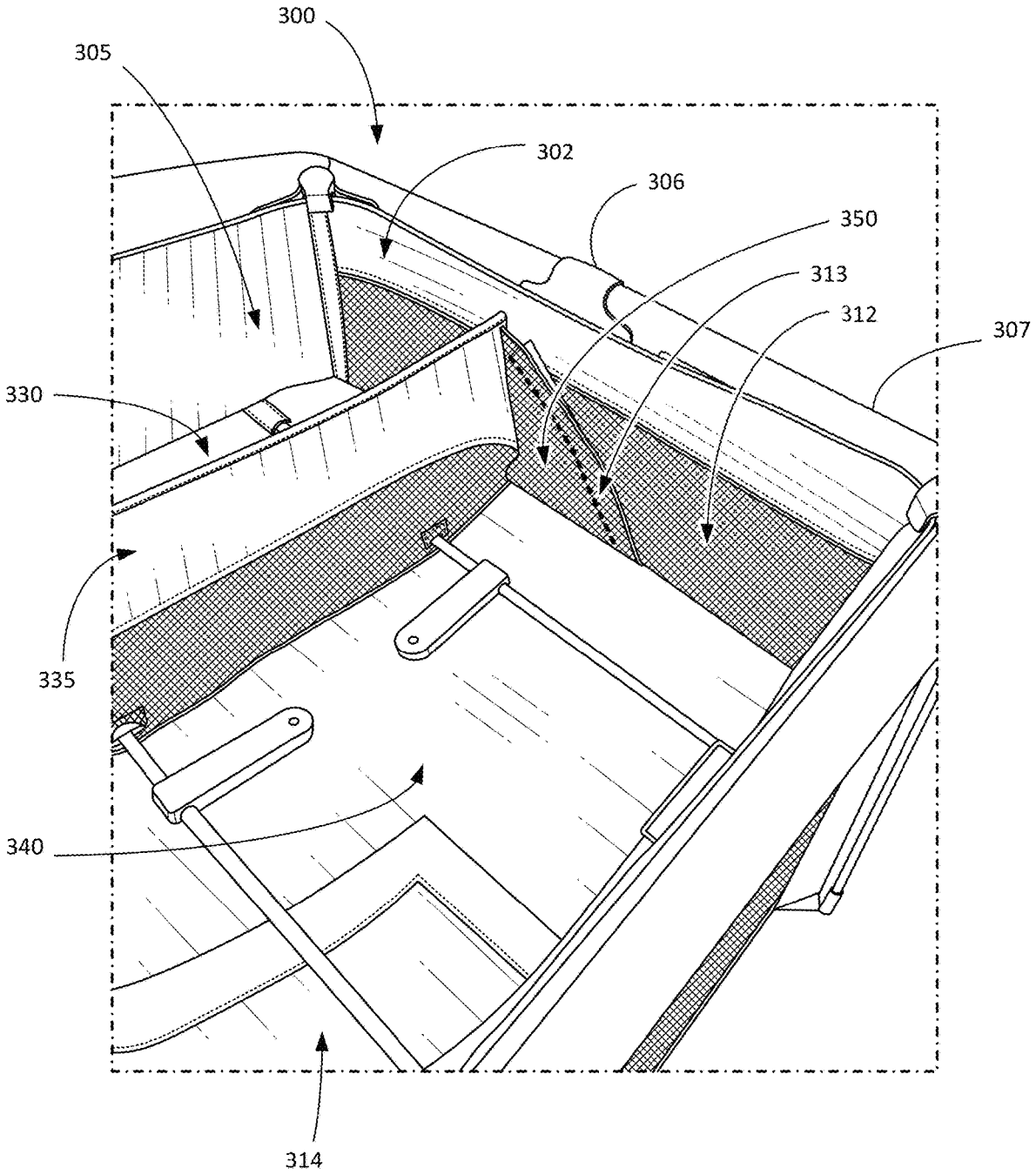
FIG. 3 is perspective view of a child support system including a support structure and a divider in upward position, in accordance with one or more example embodiments of the present disclosure.

Referring now to FIG. 3, a perspective view of a child support system including a support structure and a divider in upward position is depicted, in accordance with one or more example embodiments of the present disclosure. As shown in FIG. 3, child support system 300 may be the same or similar to child support system 100 of FIG. 1. Support structure 302 may be the same as or similar to support structure 106 and may be connected to walls 312 of the base of child support structure 300 via clips 306 which may conform to or otherwise fit over a top portion of walls 307.

Divider 335 may extend across support structure 350 and may include wings 350. In FIG. 3, divider 335 is illustrated in the upward position. Divider may rotate 90 degrees to a downward position. Wings 350 may include a connection region 313 which may connect to a connection portion of a wall of walls 312 of support structure 350. In one example, wing 350 may include a first end connected to divider 335, a second end connected to bottom portion 314, and a third end having connection region 313 and that is free standing. Connection region 350 and/or connection portion of the support structure may be velcro and/or any suitable connection mechanism (e.g., snaps, buckles, buttons, zipper, etc.). It is understood that wings (e.g., 350) may be optional.

As shown in FIG. 3, wing 350 may connect divider 335 to wall 312 and secure divider 335 in the upright position. When divider 335 is in the upright position, area 305 defined by walls 312 and bottom portion 314 may be divided into first portion 330 and second portion 340. For example, divider 335 may divide area 305 into a first half and a second half of area 305. Alternatively, first portion 330 and second portion 340 may be different sizes. While only a single divider is illustrated in FIG. 3, multiple dividers may alternatively be used to divide area into more than two spaces.

Figure 4:
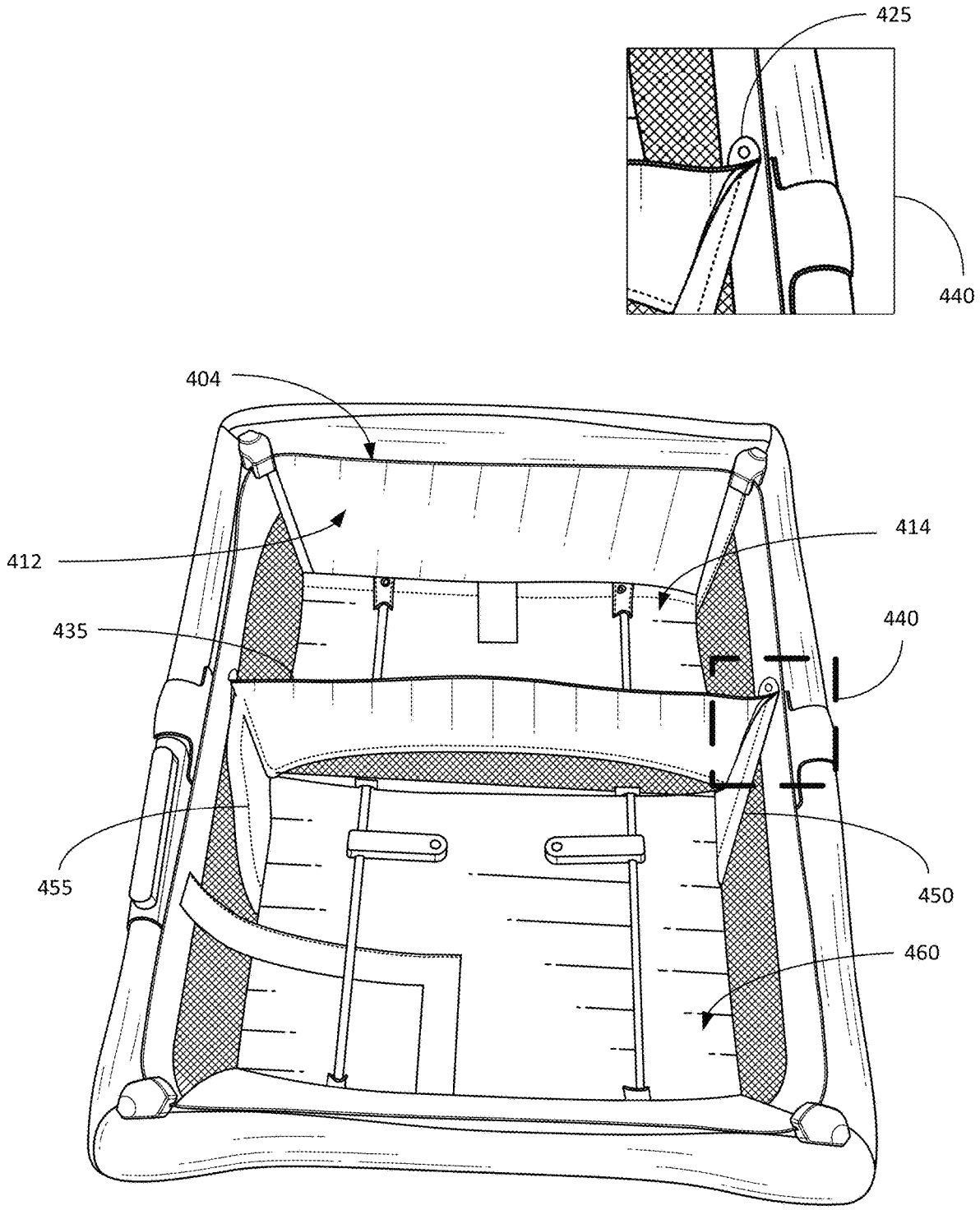
FIG. 4 is top down view of a child support system including a support structure and a divider in upward position, in accordance with one or more example embodiments of the present disclosure.

Referring now to FIG. 4, a top down view of a child support system including a support structure and a divider in upward position is depicted, in accordance with one or more example embodiments of the present disclosure. As shown in FIG. 4, support structure 404, which may be the same as or similar to support structure 106 of FIG. 1 is illustrated. Divider 435 is illustrated secured in an upward position.

Divider 435 may include wing 455 and wing 450. Each of wing 455 and wing 450 may be the same as or similar to wing 350 of FIG. 3. Wing 455 and wing 450 may alternatively be positioned on an opposite side of divider 435. It is understood that the connection region of wings 455 and 450 may be disconnected from connection regions of walls 412 to release divider 435 to permit divider 435 to transition from the upward position to a downward position. In the downward position, the area defined by walls 412 and bottom portion 414 may be undivided.

As shown in view 440, divider 435 may further include tab 425. Tab 425 may extend from an end of divider and may include a fixation portions that may be connected to walls 412. For example, fixation portions may be velcro portion that are positioned around a loop structure of walls 412 such that tab 425 may be fixed to itself. Alternatively, tab 425 may include a button and a backside of divider 435 may include a button receiving portion or the wall may include a loop structure tab may also include the button receiving portion. In yet another example tab 425 may include a buckle and a wall of walls 412 may include a buckle receiving portion. It is understood that any other suitable securing mechanism may be used to secure tab 425 to wall 412.

Figure 5:
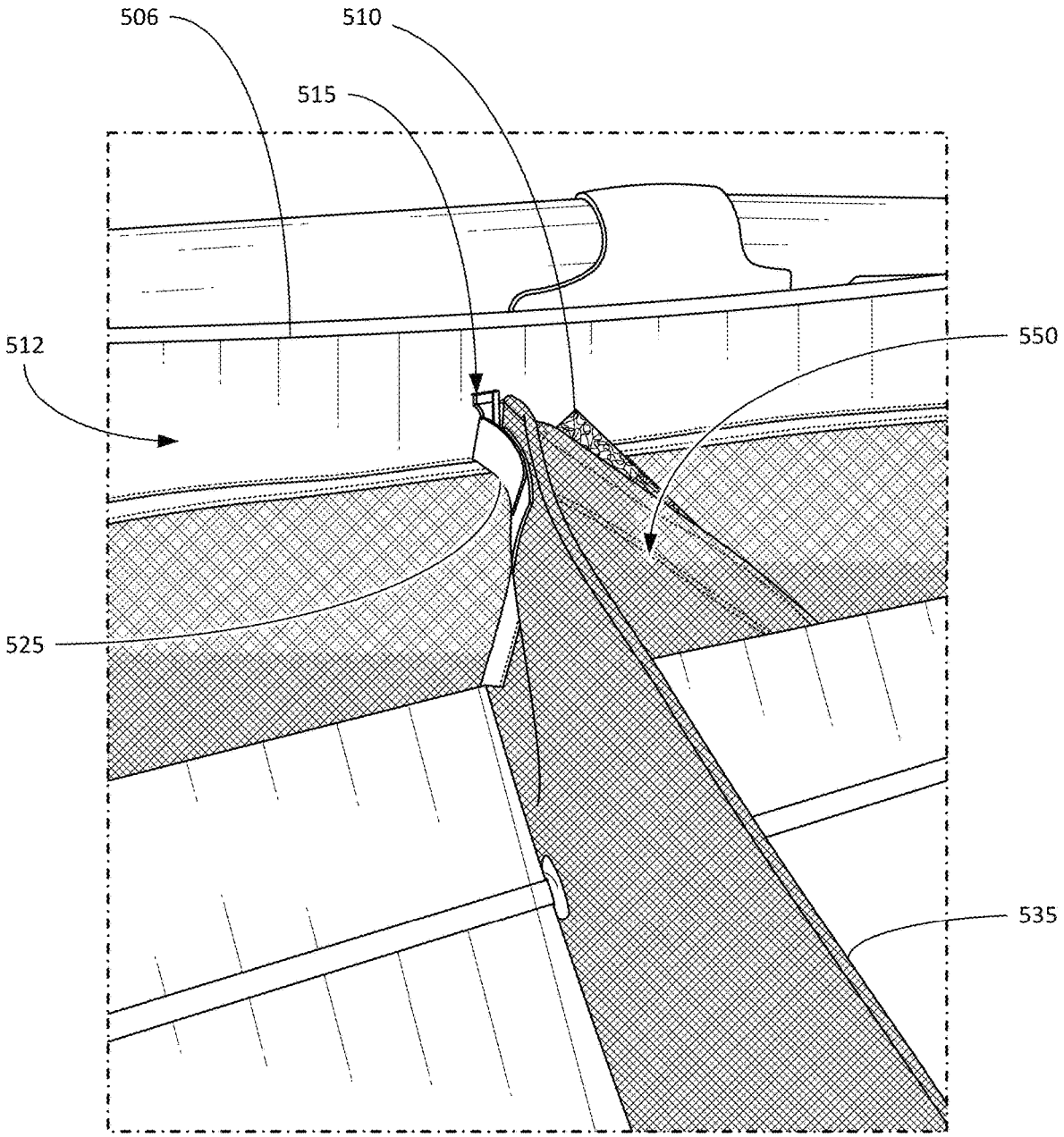
FIG. 5 is a perspective view of a divider and a wing support of the child support system in an upward position, in accordance with one or more example embodiments of the present disclosure.

Referring now to FIG. 5, a perspective view of a divider and a wing support of the child support system in an upward position is depicted, in accordance with one or more example embodiments of the present disclosure. As shown in FIG. 5, support structure 506 may be the same as support structure 104 of FIG. 1. Divider 535 may include wing 550 at one end which may include a connector for connecting to connection region 510. It is understood that connection region 510 and the connector may be velcro.

Divider 535 may further include tab 525 which may extend from one end of divider 535. Tab 525 may include velcro on one side. A backside of divider 535 may include a velcro receiving portion for connecting to tab 525. Tab 525 may be positioned through loop structure 515 of wall structure 512. Once tab 515 is positioned through loop structure 515, tab 525 may be secured to divider 535, for example. Together, wing 550 and tab 525 may secure divider 535 to wall 512 in the upward position. Alternatively, other connection mechanisms may be used other than loop structures (e.g., buckles, velcro, buckles, snaps, webbing etc.).

Figure 6A:
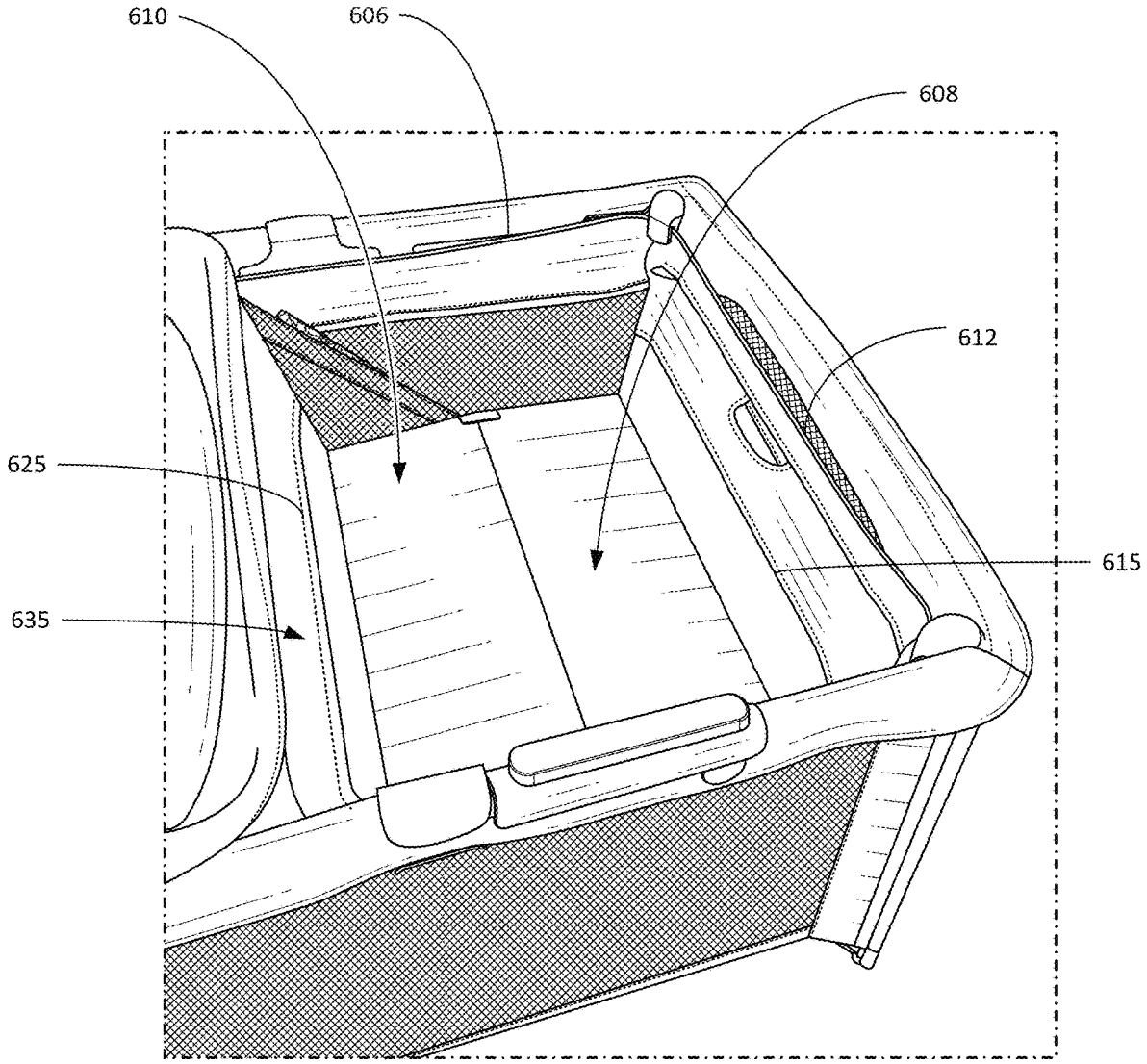
FIGS. 6A-6B are perspective views of a divided support structure with a multi-paneled structure positioned within pockets of a divider and a wall of the support structure, in accordance with one or more example embodiments of the present disclosure.
Figure 6B:
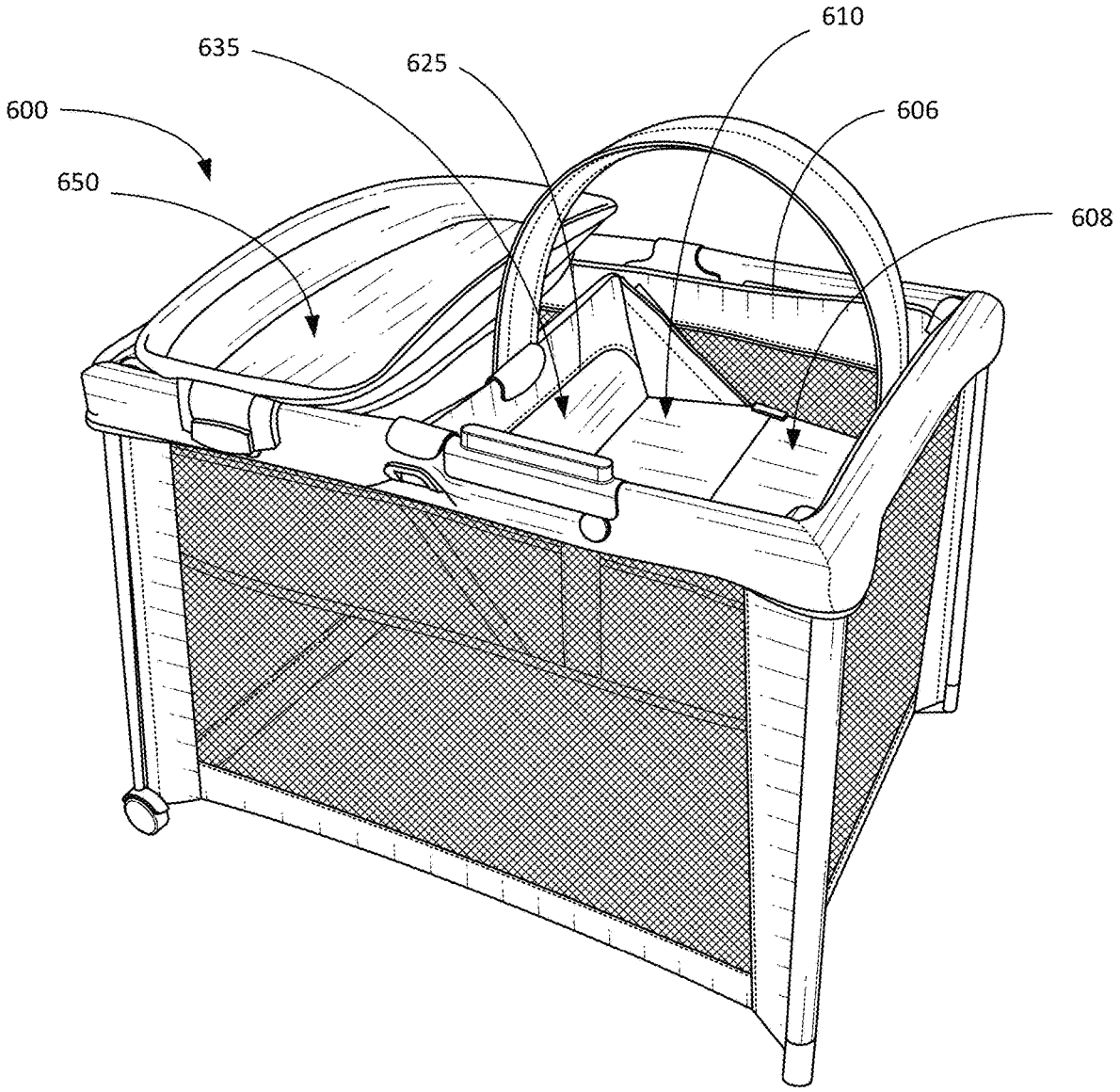

Referring now to FIGS. 6A-6B, perspective views of a divided support structure with a multi-paneled structure positioned within pockets of a divider and a wall of the support structure is depicted, in accordance with one or more example embodiments of the present disclosure. As shown in FIGS. 6A-6B, divider 535 of support structure 606 may be secured in an upward position. Divider 635 may optionally include pocket 625 for receiving a portion of multi-paneled structure 608, which may be the same as or similar to multi-paneled structure 108 of FIG. 1. It is understood that the divider may not include a pocket and divider may connect to a multi-paneled structure via any other connection mechanism (e.g., velcro, buckles, snaps, buttons, webbing, etc.). Similarly wall 612 may not include a pocket and instead wall 612 may connect to a multi-paneled structure via any other connection mechanism. In one example, divider 635 may optionally include a board or other rigid insert.

Wall 612 may similarly include pocket 615 for receiving s portion of multi-paneled structure 608. A first end of multi-paneled structure 608 may be positioned into pocket 625 and a second end of multi-paneled structure may be positioned into pocket 615 to form child support area 610 which may be smaller than the area defined by walls 612 and the bottom portion of the support structure.

As shown in FIG. 6B, support structure 606 of child support system 600 may be divided by divider 635 into child support area 610 and into secondary area 650. Secondary area 650 may be used for to connect different structures and/or components to child support system 600. For example, a changing table may be connected to child support system 600 in secondary area 650. Alternatively, a second child support area may be formed next to child support area 610, which may be the same as or similar to child support area 610.

Though the disclosed examples include particular arrangements of a number of parts, components, features, and aspects, the disclosure is not limited to only those examples or arrangements shown. Any one or more of the parts, components, features, and aspects of the disclosure may be employed alone or in other arrangements of any two or more of the same.

Although certain product features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Unless otherwise noted, the terms used herein are to be understood according to conventional usage by those of ordinary skill in the relevant art. In addition to the definitions of terms provided below, it is to be understood that as used in the specification and in the claims, "a" or "an" may mean one or more, depending upon the context in which it is used.

Throughout this application, the term "include," "include (s)" or "including" means "including but not limited to." Note that certain embodiments may be described relating to a single glass, but the corresponding description should be read to include embodiments of two or more glasses. Different features, variations, and multiple different embodiments are shown and described herein with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and drawings includes examples of systems, apparatuses, methods, devices, and/or techniques. It is, of course, not possible to describe every conceivable combination of components and/or methods for purposes of describing the various elements of the disclosure, but it may be recognized that many further combinations and permutations of the disclosed elements are possible. Accordingly, it may be apparent that various modifications may be made to the disclosure without departing from the scope thereof. In addition, or as an alternative, other embodiments of the disclosure may be apparent from consideration of the specification and annexed drawings, and practice of the disclosure as presented herein. It is intended that the examples put forth in the specification and annexed drawings be considered, in all respects, as illustrative and not limiting. Although specific terms are employed herein, they are used in a generic and descriptive sense only and not for purposes of limitation.

What is claimed is:

1. A child support system having dividable spaces, the child support structure comprising:

a support structure having a set of walls and a bottom portion coupled to the set of walls, a first and second wall of the set of walls each having a connection portion, and a third wall of the set of walls having a first pocket;

a divider positioned between the first and second wall, the divider coupled to the bottom support and configured to transition between a first position parallel with the bottom portion and a second position orthogonal to the bottom portion, the divider having connectors at a first and a second end of the divider configured to couple to a respective connection portion, and the divider having a second pocket; and a multi-paneled structure having a first end configured to be positioned in the first pocket and a second end configured to be positioned in the second pocket.

2. The child support system of claim 1, wherein the child support structure is a playard or a crib.

3. The child support system of claim 1, further comprising a base with four walls, wherein the support structure is configured to couple to an upper portion of the base.

4. The child support system of claim 1, wherein the divider has a first wing having a first side connected to the divider, a second side connected to the bottom portion, and third side that is freestanding, wherein the first wing is positioned at a first end of the divider.

5. The child support system of claim 4, wherein the first wing has a connection region configured to connect to the first wall.

6. The child support system of claim 4, wherein the divider has a second wing having a fourth side connected to the divider, a fifth side connected to the bottom portion, and sixth side that is freestanding, wherein the second wing is positioned at a second end of the divider.

7. The child support system of claim 6, wherein the second wing has a connection region configured to connect to the second wall.

8. The child support system of claim 1, wherein the multi-paneled structure is configured to extend along a length of the bottom portion.

9. The child support system of claim 8, wherein the multi-paneled structure has an initial panel configured to be inserted into the first pocket, a final panel configured to be inserted into the second pocket, and at least one panel configured to be positioned between the initial panel and the final panel.

10. The child support system of claim 1, wherein the connection portion of each of the first and second wall are a first velcro side and the connectors of the divider are second velcro sides configured to mate with respective first velcro sides.

11. The child support system of claim 1, wherein the connection portions of each of the first and second wall are loop structures.

12. The child support system of claim 11, wherein the connectors of the divider are tabs having velcro portions and configured to extend through respective loop structures to secure the divider to the set of walls.

13. The child support system of claim 11, wherein the connectors of the divider are tabs having button portions and configured to extend through respective loop structures to secure the divider to the set of walls.

14. The child support system of claim 1, wherein the divider is coupled to the bottom portion such that the divider divides the bottom portion into a first half and a second half of the bottom portion when the divider is in the second position.

15. A child support system having dividable spaces, the child support structure comprising a support structure having a set of walls and a bottom portion coupled to the set of walls, a first and second wall of the set of walls each having a connection portion;

a divider positioned between the first and second wall, the divider coupled to the bottom support and configured to transition between a first position parallel with the bottom portion and a second position orthogonal to the bottom portion, and the divider having connectors at a first and second end of the divider configured to couple to respective connection portions to secure the divider in the second position, wherein the set of walls includes a third wall having a first pocket and wherein the divider has a second pocket; and a multi-paneled structure configured to cover the bottom portion when the divider is in the first position and configured to at least partially fit into the first pocket and the second pocket when the divider is in the second position.

16. The child support system of claim 15, wherein the divider is coupled to the bottom portion such that the divider divides the bottom portion into a first half and a second half of the bottom portion when the divider is in the second position.

17. The child support system of claim 15, wherein the divider has a first wing having a first side connected to the divider, a second side connected to the bottom portion, and third side that is freestanding, and wherein a first connector of the connectors is positioned on the third side.

18. The child support system of claim 17, wherein the divider has a second wing having a fourth side connected to the divider, a fifth side connected to the bottom portion, and sixth side that is freestanding, and wherein a second connector of the connectors is positioned on the sixth side.

* * * * *